United States Patent [19]

Wade

[11] 4,433,366

[45] Feb. 21, 1984

[54] POOL LIGHT MOUNTING STRUCTURE

[76] Inventor: Charles E. Wade, 3601 S. Sentous, #E-149, West Covina, Calif. 91792

[21] Appl. No.: 429,538

[22] Filed: Sep. 30, 1982

[51] Int. Cl.[3] ..... F21V 29/00

[52] U.S. Cl. ..... 362/267; 362/158; 362/294; 362/306; 362/311; 362/362; 362/373; 362/374; 362/375

[58] Field of Search ..... 362/158, 294, 306, 311, 362/267, 362, 373, 374, 375

[56] References Cited

U.S. PATENT DOCUMENTS 3,337,725 8/1967 Nash ..... 362/267

3,612,852 10/1971 Bogossian ..... 362/267

*Primary Examiner*—Stephen J. Lechert, Jr.

*Attorney, Agent, or Firm*—Boniard I. Brown

[57] ABSTRACT

A structure for providing a light in the side of a swimming pool beneath the water. The structure primarily is constructed from sheet metal and includes a bulb shield and receptacle, a front lens, a front mounting ring and a sealing ring. The sealing ring forces portions of the shield and the mounting ring into sealing arrangement with a ring seal mounted about the lens. The seal and the adjacent sealing structure allow steam which may be generated by heat from the enclosed bulb to escape into the water but prevent the water from entering the structure. The structure can be used in traditional concrete or Gunite pools and with an additional component, it can be installed in vinyl lined pools.

11 Claims, 10 Drawing Figures

POOL LIGHT MOUNTING STRUCTURE

BACKGROUND OF THE INVENTION

Underwater pool lights are used to enhance the beauty of swimming pools and make their usage during darkness safer and more aesthetically desirable. Since the light bulb producing the light normally is below the water level, it must be sealed in an enclosure to prevent contact with the pool water. When the light bulb in such underwater enclosure fails, the water level in the pool either must be lowered below the light enclosure so that a dry installation can be made or the enclosure must be moved above the water. Removable bulb enclosures exist, however the sealing gaskets heretofore employed therein are a continual problem since they tend to have many parts, are expensive, and when water inevitably leaks into the area about the light bulb, it is turned into steam which can generate pressure high enough to fail the structure sometimes by shattering the lens of the enclosure and blowing the glass from the lens into the pool. This has a tendency to cause personal injury. Also, the extra force required for failure often is provided by an adjacent swimmer.

When such enclosures are installed in pools having vinyl pool liners, the vinyl pool liner tends to become stretched and develop holes or breaks, resulting in leakage of pool water and the requirement for replacement. Vinyl liners are expensive, costing approximately $1500, and damage thereto is difficult and expensive to repair.

Therefore there has been a need for a pool light mounting structure which can be constructed relatively economically, is capable of relieving any steam pressure which might build up from the bulbs heat without generating a reverse leakage path, which can be constructed economically and easily from sheet metal rather than castings or moldings, and which is adaptable not only to traditional concrete and Gunite pools but also vinyl lined pools.

BRIEF DESCRIPTION OF THE PRESENT INVENTION

To provide a pool light with the present invention, a formed sheet metal niche is formed in the side of a concrete pool during its initial construction or a hole is provided through the side of the pool when it is a vinyl lined shell type. This outer housing of the structure is designed to be wet, that is water is allowed to remain therein. Electrical power is fed through the niche by suitable waterproof connections and cables. A light support assembly is positioned within the niche, being connected to the niche by means of an outer ring which also serves as a decorative outer border for a heavy glass or plastic lens through which light can pass into the pool but which protects the bulb from damage. In addition to the lens, the support assembly also includes a light bulb housing, a bulb receptacle, a seal and a V shaped clamping band. The outer ring has an inwardly extending inner flange which cooperates with an outer ring flange of the light bulb housing, the outer circular edge of the lens and the seal to form a seal. The seal usually is of the elastomeric type and is shaped to fit the lens ring edge. The seal also includes an outer spike shaped ring rib which leans toward the water. This rib allows steam or other generated pressure within the housing and lens to escape toward the water but prevents water from passing in the other direction to contact the bulb. The decorative ring does not form a seal interface with the niche so that steam escaping into the shell can further escape into the water. The V clamping band is used to retain the housing and the outer ring together over the seal about the lens. To change a bulb, the outer ring housing is disconnected from the niche and the loose assembly is raised above the water line. The V clamping band is removed allowing disassembly of the housing from the lens and replacement of the bulb. The entire assembly is then reconstructed, the V clamping band tightened to seal the assembly and it is then placed back in the niche. Suitable cable is provided within the niche to allow the sealed assembly to be lifted above water level. When used with vinyl pools, an additional ring is provided about the outer periphery of the decorative ring which has a pair of ring face seals between which the vinyl liner is positioned. These seals are to protect the vinyl liner from damage while preventing the water within the niche from flowing behind the vinyl liner.

Therefore it is an object of the present invention to provide an improved pool light mounting structure whose major components can be made economically from sheet metal.

Another object is to provide a pool light mounting structure having a seal to prevent water from reaching the light bulb which relieves any steam pressure therein which might be generated by the heat of the bulb.

Another object is to provide a pool light mounting structure which prevents dangerous buildup of steam pressure.

Another object is to provide a pool light mounting structure which can be used with either concrete, Gunite, or vinyl lined pools.

Another object is to provide a swimming pool light mounting structure which allows changing of a burned out bulb without requiring a replacement seal every time the job is accomplished.

These and other objects and advantages of the present invention will become apparent to those skilled in the art after considering the following detailed specification in conjunction with the accompanying drawings wherein:

DETAILED DESCRIPTION OF THE SHOWN EMBODIMENT

Figure 1:
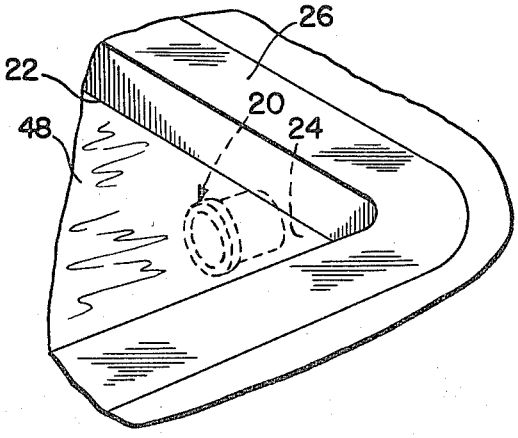
FIG. 1 is a perspective view of the present invention in its intended environment, mounted below the water level of a swimming pool.
Figure 7:
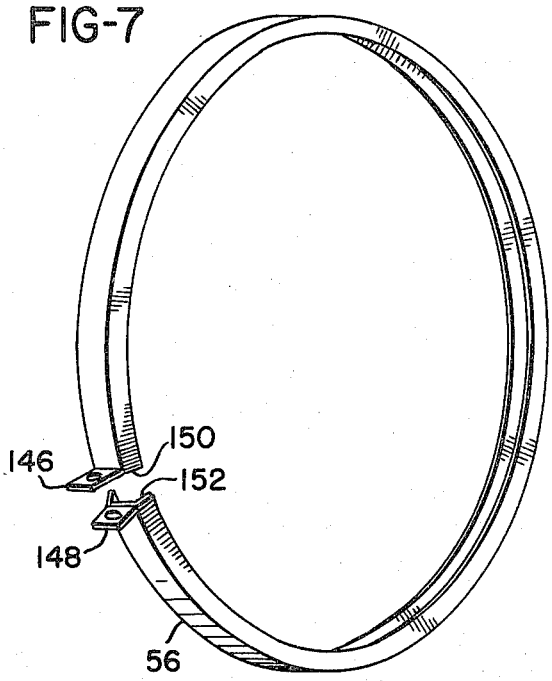
FIG. 7 is a perspective view of the V clamping band used in the present invention.
Figure 2:
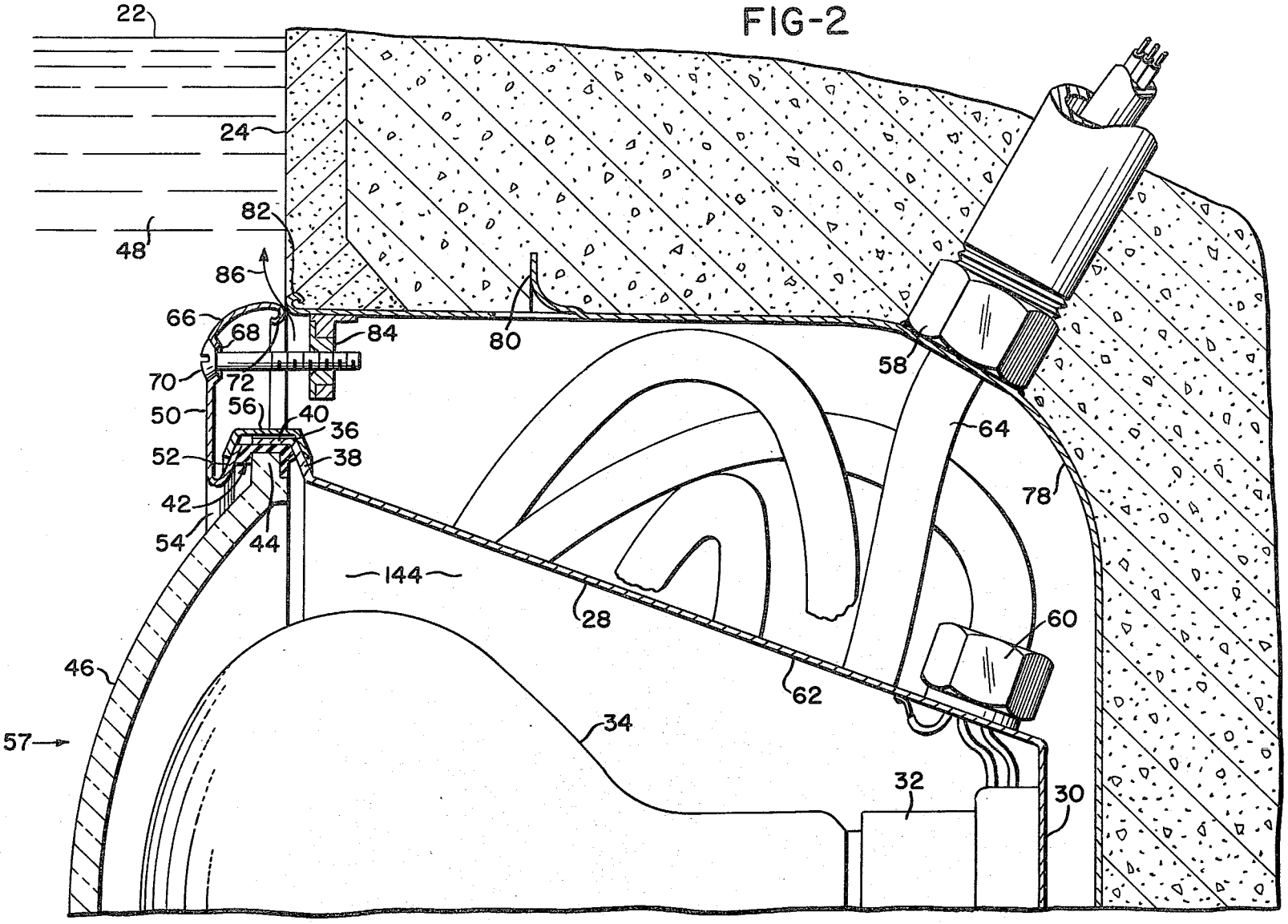
FIG. 2 is a partial cross-sectional view of the present invention as used with concrete or Gunite pools.
Figure 3:
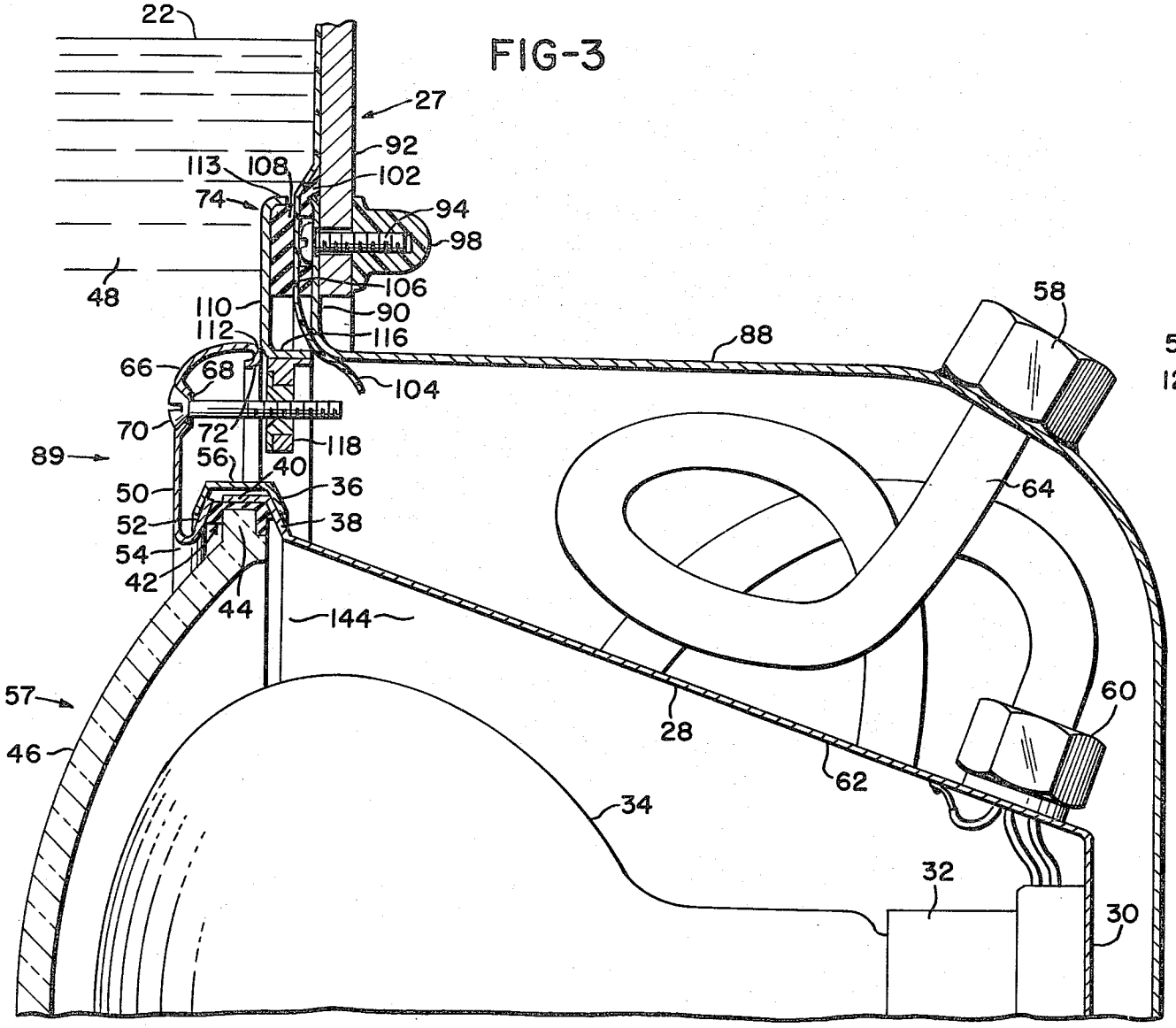
FIG. 3 is a cross-sectional view of the present invention including an additional seal structure for use with vinyl lined pools.

Referring to the drawings more particularly by reference numbers, number 20 in FIG. 1 refers to a pool light mounting structure constructed according to the present invention, installed beneath the water level 22 in the wall 24 of a concrete swimming pool 26 or vinyl lined pool 27 (FIG. 3). As shown in FIGS. 2 and 3, the structure 20 includes a frustroconical sheet metal bulb enclosure 28 whose relatively flat, back surface 30 includes a receptacle 32 for a light bulb 34. The bulb enclosure 28 also includes a front flange 36 having an inner frustroconical portion 38 and an outer circumferential ring portion 40. The ring portion 40 compresses a ring seal 42 constructed from suitable sealing material into sealing contact with an outer ring flange 44 of a lens 46 constructed from suitable transparent material to transmit light from the bulb 34 into the water 48 of the pool 26.

A decorative face ring or mounting ring 50, preferably constructed from sheet metal is provided about the lens 46 and includes a frustroconical flange 52 at its folded under inner edge 54 which is pressed against the seal 42 by a V shaped clamping band 56. The band 56 presses both the flanges 38 and 52 together about the seal 42 to assure that the seal 42 remains in sealing contact with the outer ring flange 44 of the lens 46.

The assembly 57 made up of the bulb enclosure 28, the lens 46, the bulb 34, the seal 42 and the decorative face ring 50 are removable above the water level 22 as a unit with electrical power being fed to the bulb 34 by means of waterproof connections 58 and 60 located in the pool wall 24 and the frustroconical portion 62 of the bulb enclosure 28 respectively. A waterproof electrical cable 64 having sufficient length to allow the assembly 57 to be moved above the water level 22 for bulb replacement is provided between the connectors 58 and 60.

Figure 4:
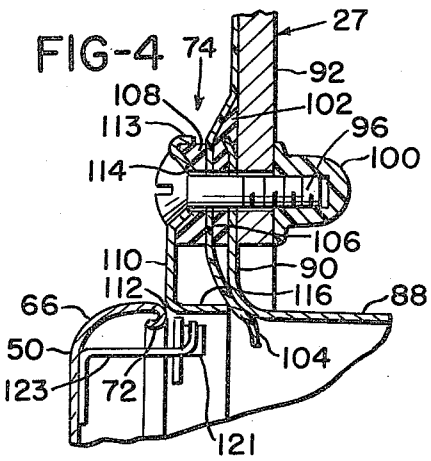
FIG. 4 is a detailed view of the additional seal structure of FIG. 3.

The outer edge 66 of the decorative face ring 50 includes holes 68 through which mounting bolts 70 are extended to hold the assembly 57 in place in the wall 24. The outer edge 66 also includes an inwardly turned abutment ring 72 which spaces the assembly 57 from the wall 24 of the pool 26, as shown in FIG. 2, or from a vinyl layer seal assembly 74, as shown in FIGS. 3 and 4.

When the assembly 57 is to be installed in a concrete or Gunite pool 26 as shown in FIG. 2, a protective shell 78 is provided in the wall 24 of the pool 26 at the time of its construction. The shell 78 preferably is constructed from sheet metal and includes outwardly extending tangs 80 to lock it in the concrete wall 24 of the pool 26. An outwardly turned, outer abutment surface flange 82 thereof is sized and positioned to mate with the abutment ring 72 of the decorative face ring 50. Inwardly facing projections 84 through which the bolts 70 threadably attach, maintain the assembly 57 within the shell 78. As shown, the shell 78 is sized and shaped to accommodate the assembly 57 and also the length of cable 64 required to allow the assembly 57 to move above water level 22. Water 48 normally is present between the shell 78 and the bulb enclosure 28. Therefore it is desirable that the contact between the abutment ring 72 and the flange 82 does not provide a seal that would allow pressure to build up therewithin. The outward flow of pressure is shown by an arrow 86 in FIG. 2.

A slightly different shell 88 must be provided for the assembly 57 when it is to be used in the vinyl linered pool 27 to form structure 89. Shell 88 includes an outer radial flange 90 which is connected to the wall 92 of the pool 27 by suitable bolts 94 and 96, and nuts 98 and 100 respectively. A liner gasket 102 is placed over the flange 90. The vinyl liner 104 is retained against the outer surface 106 of the liner gasket 102 by a ring face seal 108 retained in position by an annular flange member 110. The inner edge 112 of the annular flange member 110 provides the abutment surface for mating with the abutment ring 72 of the decorative face ring 50 while its outer circumferentially formed edge 113 acts as a retainer for the face seal 108 during assembly. The member 110 is retained in position by the bolts 96 shown in FIG. 4 which extend through a hole 114 therein through the ring face seal 108, the vinyl liner 104, the flange 90 and the wall 92. The entrapment of the vinyl layer 104 behind the ring face seal 108 and in front of the liner gasket 102 prevents tearing or stretching of the vinyl layer 104. The annular member 110 also includes an inner ring portion 116 from which extend projections 118, like projections 84, for engagement with the bolts 70 and positioned members 121 which cooperate with legs 123 extending inwardly off of the decorative ring 50 to assure alignment of the assembly 57 for installation.

Figure 5:
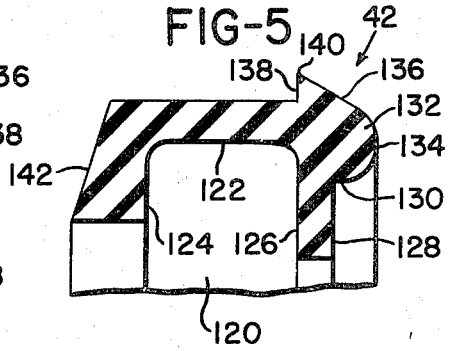
FIG. 5 is an enlarged partial cross-sectional view of the elastomeric seal of the present invention in its uninstalled form.

As shown in FIG. 5, the seal 42 includes a radially inwardly facing slot 120 for engagement with the outer ring flange 44 of the lens 46, the slot 120 including an outer circumferential surface 122 bounded by radial surfaces 124 and 126 with surface 126 being slightly wider than surface 124. The surface 126 defines one surface of a seal leg 128 whose outer end 130 includes a sideward protrusion 132 having an outer surface 134 of generally circular cross-section. The surface 134 adjoins a frustroconical surface 136 which along with a radial surface 138 forms an outwardly extending annular rib 140. The rib 140, and more particularly its outer surface 136, and the surface 134 of the protrusion 132 which acts like a portion of an O-ring, provide the primary sealing surfaces for the seal 42 against the flange 36 of the bulb enclosure 28.

Figure 6:
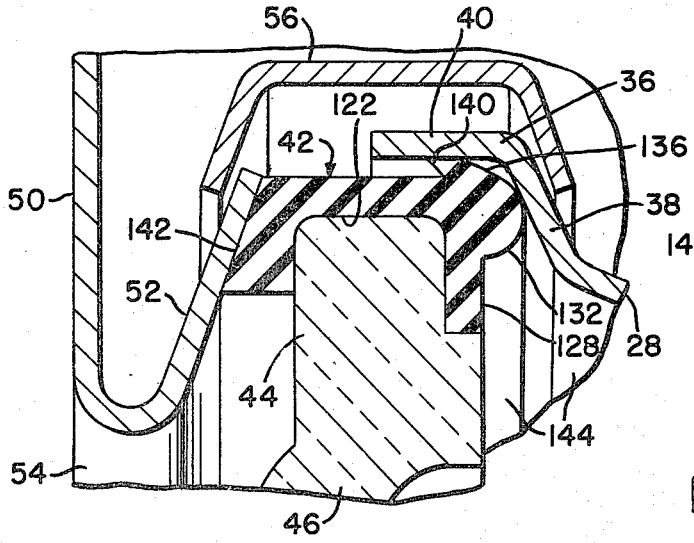
FIG. 6 is an enlarged detail cross-sectional view of the seal structure of the present invention during assembly but before tightening of the V clamping band.
Figure 8:
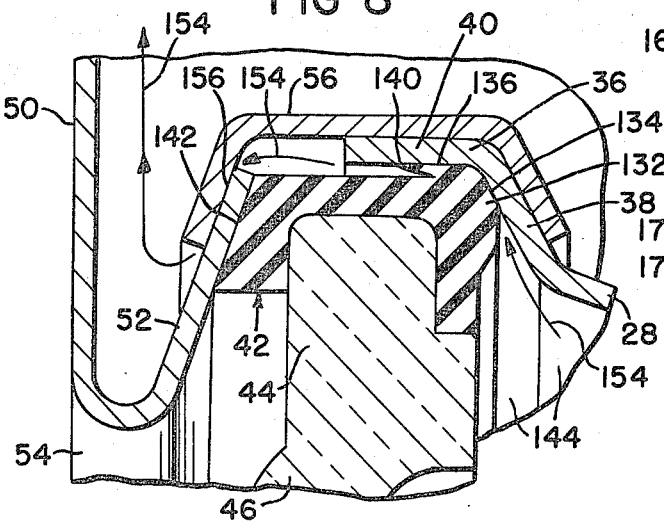
FIG. 8 is a view similar to FIG. 6 after the V clamping band has been tightened.

The seal 42 also includes a second frustroconical surface 142 which acts as a standoff for the flange 52 of the decorative ring 50 which applies force thereto to provide a seal between the surfaces 122, 124 and 126 with the outer ring flange 44 of the lens 46. The seal 42 along with the flange 36, the V clamping band 56 and the flange 52 are shown in assembled but not tightened condition in FIG. 6, wherein it can be seen that the rib 140 is bent over slightly away from the volume 144 within the enclosure 28 in which steam pressure could build up. When the V clamping band 56 is tightened, usually by means of a bolt, not shown, through clamping ears 146 and 148 on the facing opposite ends 150 and 152 thereof, the seal 42 is compressed as shown in FIG. 8 with the V clamping band 56 in intimate contact with the flange 52 of the decorative ring 50, and the inner frustronconical and circumferential ring portions 38 and 40 of the flange 36. As can be seen, the rib 140 is bent over away from the volume 144. As shown, steam represented by arrows 154, can escape past the seal 42 and its rib 140 through the interface 156 between the flange 52 and the V clamping band 56 so that pressure does not build up within the volume 144.

Figure 9:
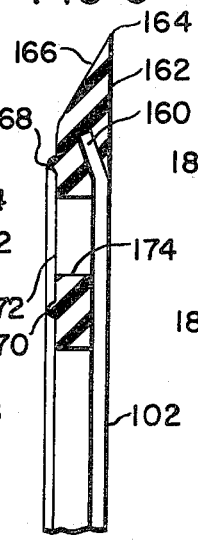
FIG. 9 is an enlarged detail partial cross-sectional view of the liner gasket of the additional seal structure of FIGS. 3 and 4.
Figure 10:
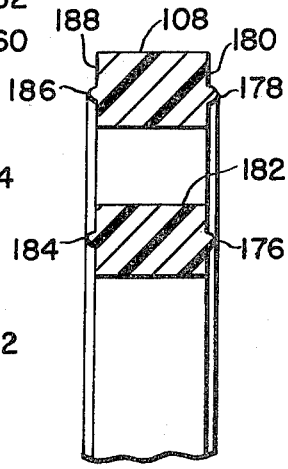
FIG. 10 is an enlarged cross-sectional view of a portion of the vinyl face sealing ring of the additional seal structure of FIGS. 3 and 4.

The other seals in the structure 20, the liner gasket 102 and the ring face seal 108 are shown in detail in FIGS. 9 and 10. In addition to providing a seal to the wall 92 of a steel pool 27, they are also designed to prevent damage to the vinyl liner 104. The liner gasket 102 is locked in position about the flange 90 by a frustroconical slot 160. Outward of the slot 160 there is a face surface 162 which seals against the wall 92. It is joined at its outer edge 164 by a frustroconical surface 166 which allows the vinyl liner 104 to smoothly ride up over the gasket 102 without damage thereto. Annular beads 168 and 170 are provided on the outer face 172 of the gasket 102 on opposite sides of holes 174 through which the bolts 94 and 96 pass. The annular ribs 168 and 170 assure a positive nondestructive seal with the vinyl liner 104. They are opposed by similar annular beads 178 and 178 on the inner ring surface 180 of the ring face seal 108 on opposite sides of the holes 182 provided for the bolts 96. The vinyl liner 104 is squeezed between the faces 172 and 180 and engaged by the beads 168, 170, 176 and 178 to provide a seal. Additional annular beads 184 and 186 are provided on the outer surface 188 so that either side 188 or 180 of the ring face seal 108 can be placed against the vinyl liner 104.

Thus there has been shown and described a novel pool light mounting structure which fulfills all the objects and advantages sought therefor. Many changes, modifications, variations and other uses and applications of the subject invention will however become apparent to those skilled in the art after considering the foregoing specification together with the accompanying drawings and claims. All such changes, modifications, variations and other uses and applications which do not depart from the spirit and scope of the invention are deemed to be covered by the invention which is limited only by the claims which follow.

What is claimed is:

1. A structure for mounting an electrical light bulb under water to a construction such as a swimming pool, the structure including:

a light bulb enclosure having:

a body with:

an outer circumferential flange; and a frustroconical portion adjacent said outer circumferential flange;

a light bulb socket within said body;

a waterproof connection to said light bulb socket through said body;

a lens with:

an outer circumferential flange positioned adjacent said outer circumferential flange of said body; and a seal between said outer circumferential flange of said body and said outer circumferential flange of said lens; and a mounting ring having:

a frustroconical inner portion in contact with said seal; and means for connecting said mounting ring to the construction.

2. The structure as defined in claim 1 wherein said light bulb enclosure further includes:

a V band positioned about said outer circumferential flange of said body, at least a portion of said frustroconical inner portion of said mounting ring, and at least a portion of said frustroconical portion of said body to compress said seal between said frustroconical inner portion of said mounting ring, said frustroconical portion of said body, said outer circumferential flange of said body, and said outer circumferential flange of said lens.

3. The structure as defined in claim 2, further including:

a niche positioned in the construction, said light bulb enclosure being positioned in said niche, said niche having:

an outer abutment surface;

a waterproof connection to a source of electrical power; and a waterproof cable of a predetermined length extending from said niche waterproof connection to said waterproof connection of said body, whereby said predetermined length of cable is sufficient to allow said light bulb enclosure and said mounting ring to be moved above the water.

4. The structure as defined in claim 3, wherein said mounting ring further includes:

a outer abutment surface adapted to engage said outer abutment surface of said niche.

5. The structure as defined in claim 4, wherein said niche further includes:

at least one inwardly extending protrusion adapted for engagement by a fastener, said means for connecting said mounting ring to the construction including:

at least one fastener engaging said mounting ring and said protrusion to hold said mounting ring outer abutment surface and said outer abutment surface of said niche together.

6. The structure as defined in claim 5, wherein the construction is a shell with a flexible liner, the shell and liner having concentric openings for said structure, wherein said mounting ring further includes:

a radial flange adapted to engage the shell about the structure opening therein, said radial flange having:

a frustroconical tip;

means for fastening said radial flange to the shell; and a first gasket including:

an outer radial surface and an adjacent frustroconical surface for contact with the liner;

an inner radial surface and an adjacent frustroconical slot for contact with said radial flange including said frustroconical tip; and a radial surface between said frustroconical surface and said frustroconical slot for contact with the shell.

7. The structure as defined in claim 6, wherein said first gasket includes:

at least one fastener opening defined therethrough, said first gasket outer radial surface including:

at least two radial beads extending outwardly therefrom on opposite sides of said opening defined through said first gasket.

8. The structure as defined in claim 6, wherein said mounting ring further includes:

an annular flange member having:

an inwardly facing radial surface; and a second gasket having:

an outer radial ring surface in contact with said inwardly facing radial surface of said annular flange member; and an inner radial ring surface in contact with the liner to squeeze the liner against said outer radial surface of said first gasket.

9. The structure as defined in claim 8, wherein said second gasket includes:

at least one fastener opening defined therethrough, said second gasket inner radial ring surface including:

at least two radial beads extending outwardly therefrom on opposite sides of said opening defined through said second gasket.

10. The structure as defined in claim 2, wherein said seal defines a radial, inwardly facing slot for engaging said outer circumferential flange of the lens;

a radially outwardly extending peripheral rib compressed upon engagement with said outer circumferential flange of the body.

11. The structure as defined in claim 2, wherein said seal includes:

a radial, inwardly facing slot for engagement with said outer circumferential flange of said lens;

a radially outwardly extending rib including:

a front surface; and a frustroconical back surface positioned to contact said outer circumferential flange of said body and be biased toward said front surface thereby; and a ring protrusion adjacent said frustroconical back surface positioned to contact said outer circumferential flange and said frustroconical portion of said body.

* * * * *